United States Patent [19]

Cianciullo

[11] Patent Number: 4,762,154

[45] Date of Patent: Aug. 9, 1988

[54] AUTOMATIC APPARATUS FOR STRAPPING ELONGATED SUPERPOSED BODIES

[76] Inventor: Guido Cianciullo, 27/B Viale degli Eucalipti, I-84100 Salerno SA, Italy

[21] Appl. No.: 29,204

[22] PCT Filed: Jun. 16, 1986

[86] PCT No.: PCT/IT86/00043

§ 371 Date: Feb. 17, 1987

§ 102(e) Date: Feb. 17, 1987

[87] PCT Pub. No.: WO86/07618

PCT Pub. Date: Dec. 31, 1986

[30] Foreign Application Priority Data

Jun. 17, 1985 [IT] Italy ..... 48229 A/85

[51] Int. Cl.[4] ..... B21F 9/02

[52] U.S. Cl. ..... 140/119; 140/93 A; 140/57

[58] Field of Search ..... 140/53, 54, 57, 93 A, 140/93.6, 119

[56] References Cited

U.S. PATENT DOCUMENTS 3,169,559 2/1965 Working .

4,362,192 12/1982 Furlong et al. .

FOREIGN PATENT DOCUMENTS 363765 8/1981 Austria .

0099579 2/1984 European Pat. Off. .

1366477 8/1963 France .

*Primary Examiner*—Lowell A. Larson

*Attorney, Agent, or Firm*—Browdy and Neimark

[57] ABSTRACT

An automatic apparatus for strapping together a first and a second superposed elongated body (1,2) even in a nonangulated axial relationship, with particular reference to reinforcement for reinforcing concrete, essentially comprising a rotatable system of locking devices (141) capable of engaging respective ends of two wire-like elements, relatively stiff, previously proportioned and shaped, straddling over said first elongated body of under said second elongated body, side by side opposed edges of said second elongated body or said first elongated body, respectively, so that following the rotation around its own axis of said system of locking devices the ends of said wire-like elements are twisted together in pairs under said second elongated body or all together over the first elongated body, in order to perform the sought strapping.

17 Claims, 12 Drawing Sheets

21
30
25
22
IV
IV
56
41
54
58
30
VIII
VIII
16
18
1
25
2
18
IX
IX
17
17
43
19
42
42
20
43
67
67
45
46
44
48
47
49
49
47
48
46
44
45

AUTOMATIC APPARATUS FOR STRAPPING ELONGATED SUPERPOSED BODIES

The present invention relates to an apparatus capable of automatically performing, following a manual or mechanical actuation, the strapping of superposed elongated bodies in either a parallel or axially angled relationship.

More particularly, by the term "strapping of elongated bodies" the binding of reinforcing rods, bars, strips, angle iron, pipes, shafts and the like by means of relatively rigid wire-like elements of any kind of material is intended.

At present, this kind of strapping is performed by the manual winding of one or more pieces of iron wire or cord around the articles of the above mentioned kind and then twisting, with the eventual help of a suitable tool, for instance a pair of pliers or nippers, the ends of said pieces of iron wire or cord.

From the above it clearly derives that, with the method of operation above described, the strapping operation in question is time-consuming and fatiguing for the operator, upon whose personal skill the execution time, the efficiency of the result and the dimensioning with a minimum waste of the pieces of iron wire or cord used, all depend.

In other words, the operation in question performed in this way according to the prior art, may be considered in general entirely uneconomical, both from the point of view of the man-hour costs and that of the cost of the strapping material as a consequence of said unavoidable waste.

The aim of the present invention is to provide an apparatus capable of performing automatically the operation of strapping superposed elongated bodies of the abovementioned kind with an appreciable reduction of execution time as well as of the waste of strapping material, thus avoiding the abovementioned inconveniences deriving from the performance of said strapping operation according to the conventional practice presently in use.

The adoption of the apparatus of the present invention makes it possible to obtain, among other things, the following advantages:

- to ensure continued work with uniform results independent on the skill of the operator and of his physical and mental efficiency;
- to simplify to a maximum the operation;
- to render the work much easier and not at all fatiguing;
- to shorten to a maximum the operational times;
- to adjust automatically the quantity of material used for each strapping operation.

The present invention will be better illustrated hereinafter by the disclosure of preferred embodiments thereof referred to as non limitative examples, with reference to the attached drawings, wherein.

Figure 1:
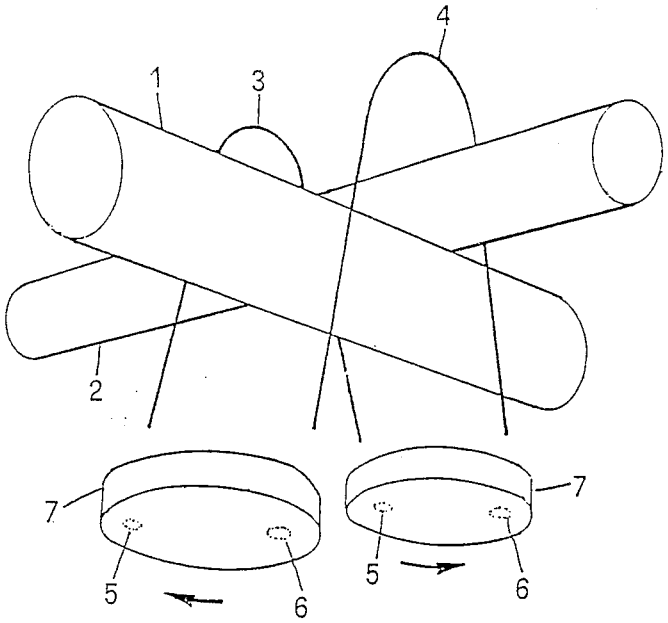
FIG. 1 is a perspective view showing schematically the principle of operation of a first embodiment of the apparatus in question.
Figure 2:
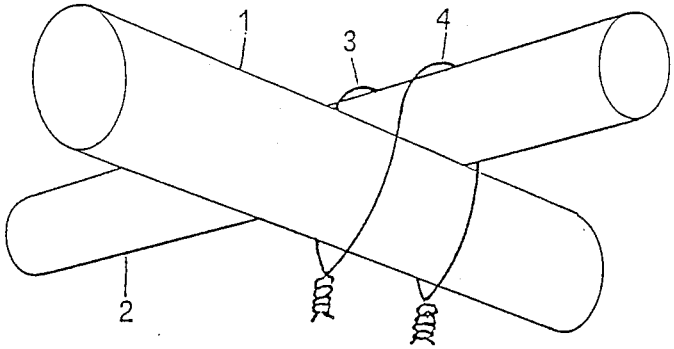
FIG. 2 is a perspective view showing schematically the result of the strapping operation performed according to the principle of operation shown in FIG. 1 of the first embodiment of the apparatus in question.

With reference to FIGS. 1 and 2, the principle of operation of a first example of embodiment of the apparatus of the present invention for strapping together two reinforcing rods 1 and 2, placed in a superposed and crossed relationship is schematically shown therein, entailing the operation of predisposing two strapping elements, with the shape of forks 3 and 4 of a relatively rigid and flexible material, straddling the upper reinforcing rod 1 on opposed edges of the lower reinforcing rod 2, to engage the corresponding ends of the forks 3 and 4 in respective holes 5 and 6 of two rotatable drums 7, to rotate said drums 7 in the sense shown with arrows so as to twist the respective ends of the forks 3 and 4, as shown in FIG. 2, performing in this way the desired strapping.

Studying FIG. 3, wherein the first example of embodiment of the apparatus of the invention is shown in an overall view, and premitting that the components shown therein will be referred to in a simplified way, deferring to the prosecution of the present discussion the description of the details relating to the members destined to the operation in the apparatus itself as specifically shown in the following figures, are shown as 8 a movable handle and as 9 a fixed handle between which a helical restoring spring 10 is arranged. The movable handle 8 has one of its ends fixed to a rounded block 11, rotatable around a pin 12, capable of rigidly connecting the first ends of two actuation levers 13 and 14, which are parallel and spaced from each other, between which a third actuation lever 15 extends having a first end which is also rotatable around the pin 12. The fixed handle 9, carrying the pin 12 transversely fastened thereto, has an extension thereof extending beyond the latter integral with the base 16 of the apparatus in question constituted by a box-like body from the lower wall of which four tubular legs 17 normally extend to each of which is externally associated a channel guide 18 and containing internally rotatable shafts connected to gears (to be better defined hereinafter), housed in the box-like base 16 destined to impart the foreseen movements to two drums 19 and 20 placed at the lower end of the respective legs 17 and which are shown in dotted lines in the disengaged position and in solid lines in the operating position.

Over the base 16 a carter 21 is arranged, fastened in front to and in communication with a parallelepipedal box member 22 containing the actuation members (better described hereinafter) which is also fastened to and in communication at the lower side with the box-like base 16.

Passing now to study in detail the constructional details for the operation of the apparatus of the present invention, reference is made initially to FIG. 4 wherein two containers or loaders are indicated by 23 and 24, capable of containing a plurality of strapping elements previously shaped and dimensioned, arranged side by side, which hereinafter will be identified as forks, owing to their shape, as is better seen in FIG. 6, and indicated with 25, only one of which is shown in each of said containers 23, 24 for the sake of clarity.

As they are utilized, the forks 25 within each loader 23, 24 are advanced by means of respective push plates 26, each one provided with an external knob 27 for the manual displacement to the start position (see also FIG. 3), under the constant bias of helical springs 28 contained in hollow cylindrical housings 29, until bringing the innermost spring of each loader 23, 24 under a respective arc-shaped slider 30 (see also FIG. 6) fastened to a pin 31 in engagement with a slot 32 (see FIG. 5) machined longitudinally in one end of a flat rod 33 the other end of which is fastened to toothed sector 34 in engagement with a corresponding toothed sector 35 on the second end of the respective lever 14, 15.

Figure 4:
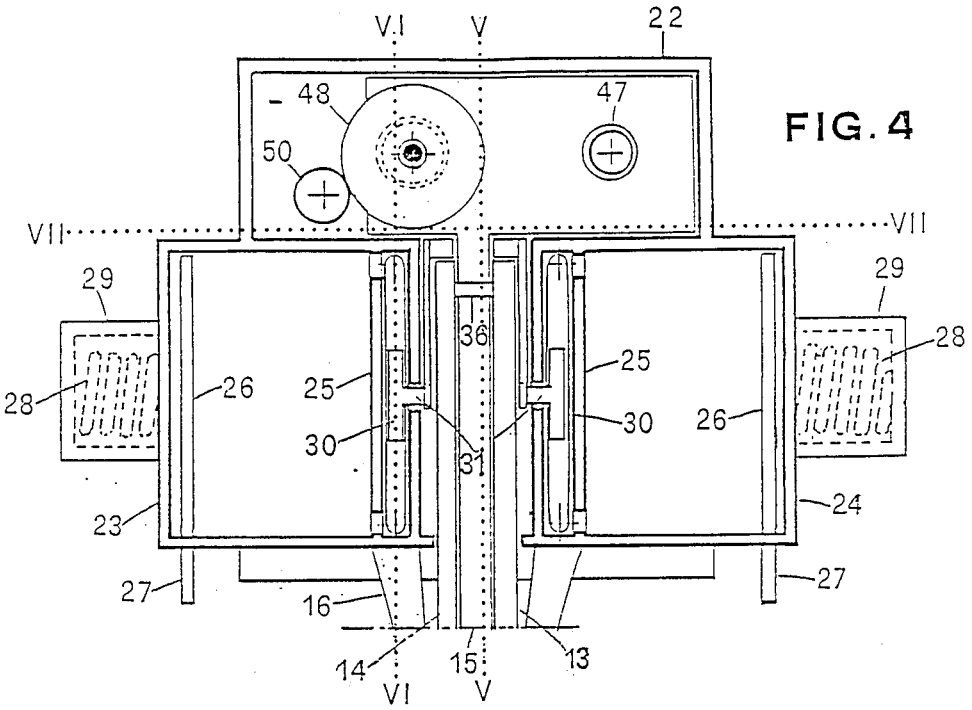
FIG. 4 is a partially sectional view taken along lines IV—IV of FIG. 5, FIG. 6 and FIG. 7.
Figure 5:
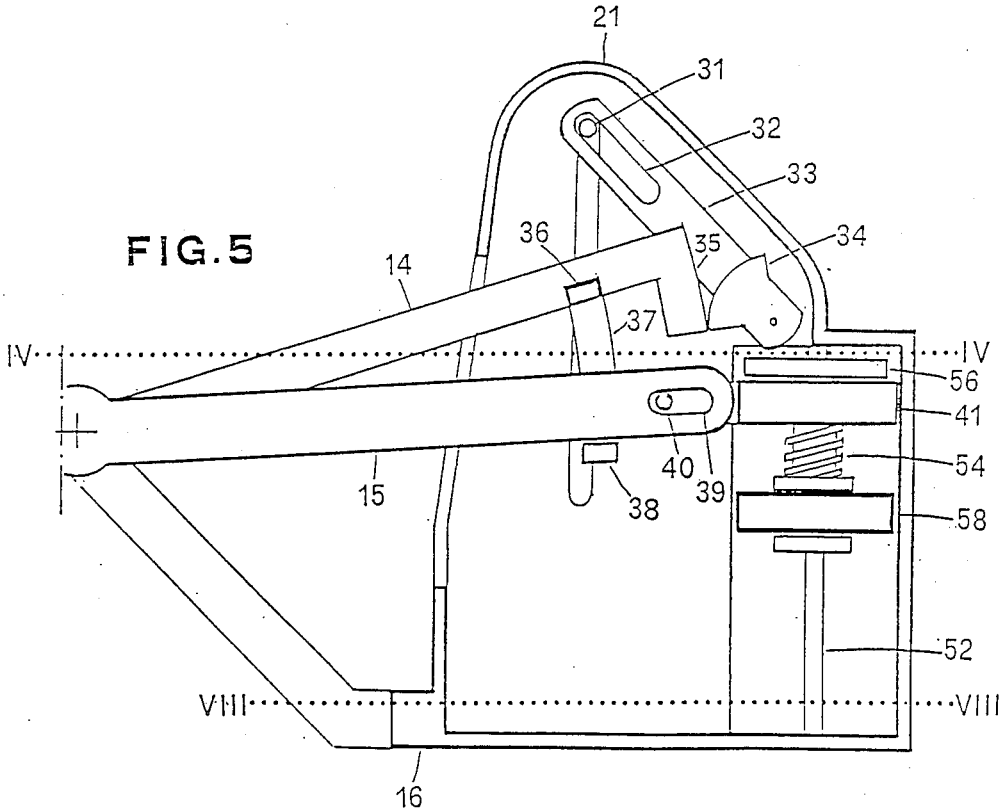
FIG. 5 is a partially sectional view taken along lines V—V of FIG. 4 and of FIG. 8.

As one may notice from FIGS. 4 and 5, the levers 13 and 14 are connected to each other by means of a tie bar 36 from the ends of which respective bars 37 with a circular section extend, one only of which is shown in FIG. 5, the free ends of which are connected to each other by means of a second tie rod 38, shown sectioned in FIG. 5, the lever 15 intermediate between the levers 13 and 14 being included between said bars 37 and having the second end, wherein a slot 39 is machined (see FIG. 5) in engagement with a fixed pin 40, as well as integral with a first movable plate 41, the function of which will be explained hereinafter, contained in the forward box 22.

Figure 6:
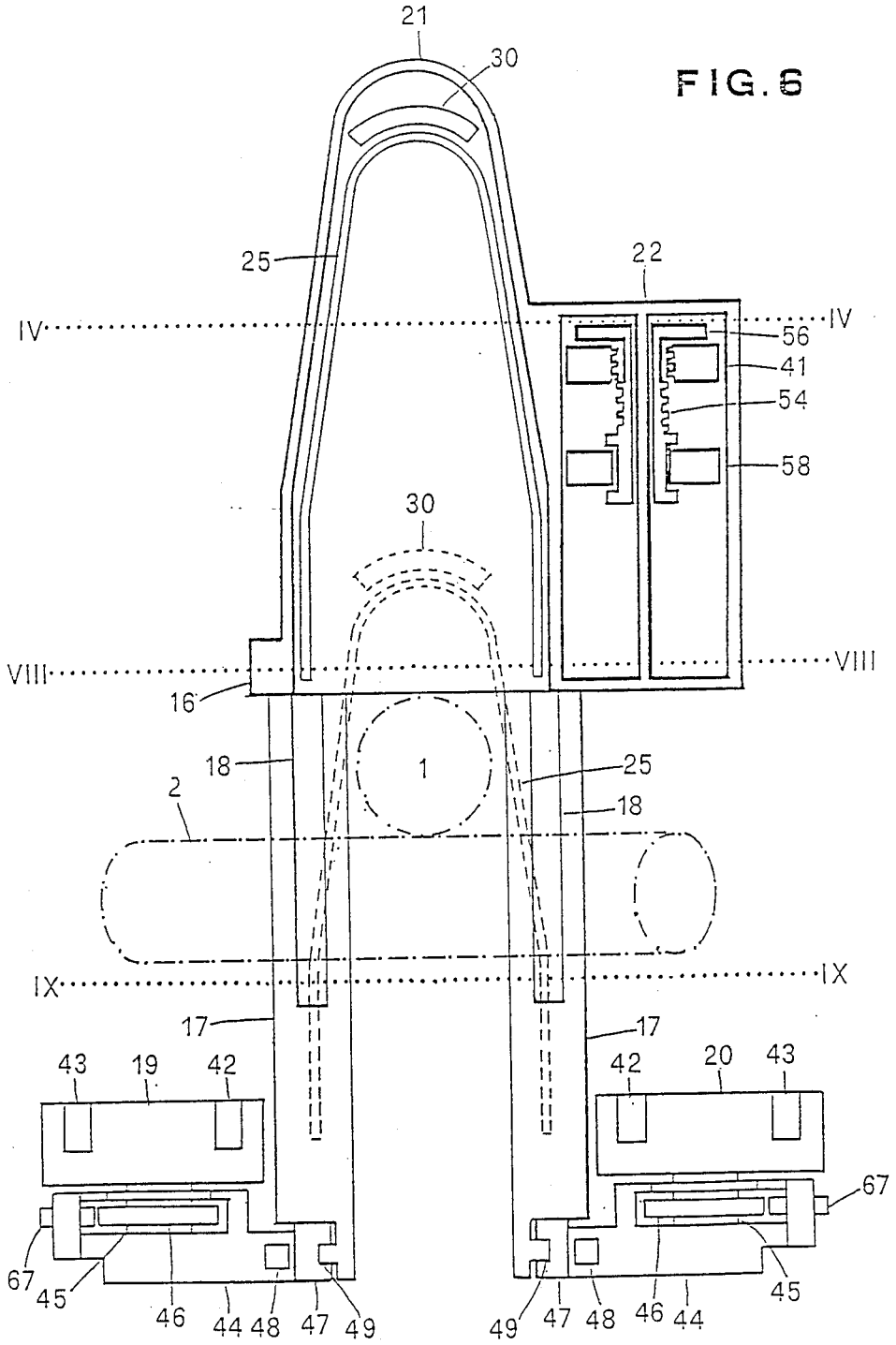
FIG. 6 is a sectional view taken along lines VI—VI of FIG. 4 and of FIG. 8.

In FIG. 6 a fork 25 may be noted, located under the respective slider 30, this fork being shown in solid lines in the position at the interior of the respective loader 23 and in dotted lines in the operative position, as a consequence of the downward movement of the slider 30, straddling the upper reinforcing rod 1, and with the legs, extending on one side of the lower reinforcing rod 2, in engagement with the corresponding channel shaped guides 18 associated to a first and a second leg 17 lying on a longitudinal plane of the apparatus, the ends of the arms of the forks 25 extending beyond the lower ends of said channel shaped guides 18 until they arrive at the level of respective recesses 42 and 43 arranged on the drums 19 and 20 within which they will be engaged during the operation, as will be described below in greater detail.

From FIG. 6 it may be also remarked that each of the drums 19, 20 is rotatably mounted on a respective support 44 by means of a rotation pin 45 on which a toothed wheel 46 is keyed, arranged, as it will be seen hereinafter, to impart to the associated drum 19, 20 the rotation movement around its axis for the execution of the twisting of the ends of the forks 25 engaged with it. One end of the support 44 is integral with the lower end of respective rotation shafts 47 extending respectively in the interior of the left forward and rear legs 17 as seen in FIG. 3, up to the interior of the box-shaped base 16. In each support 44, finally, a square hole 48 is machined, to which a similarly shaped tooth 49 in the respective leg 17 corresponds, the purpose of which will be clarified hereinafter.

Figure 3:
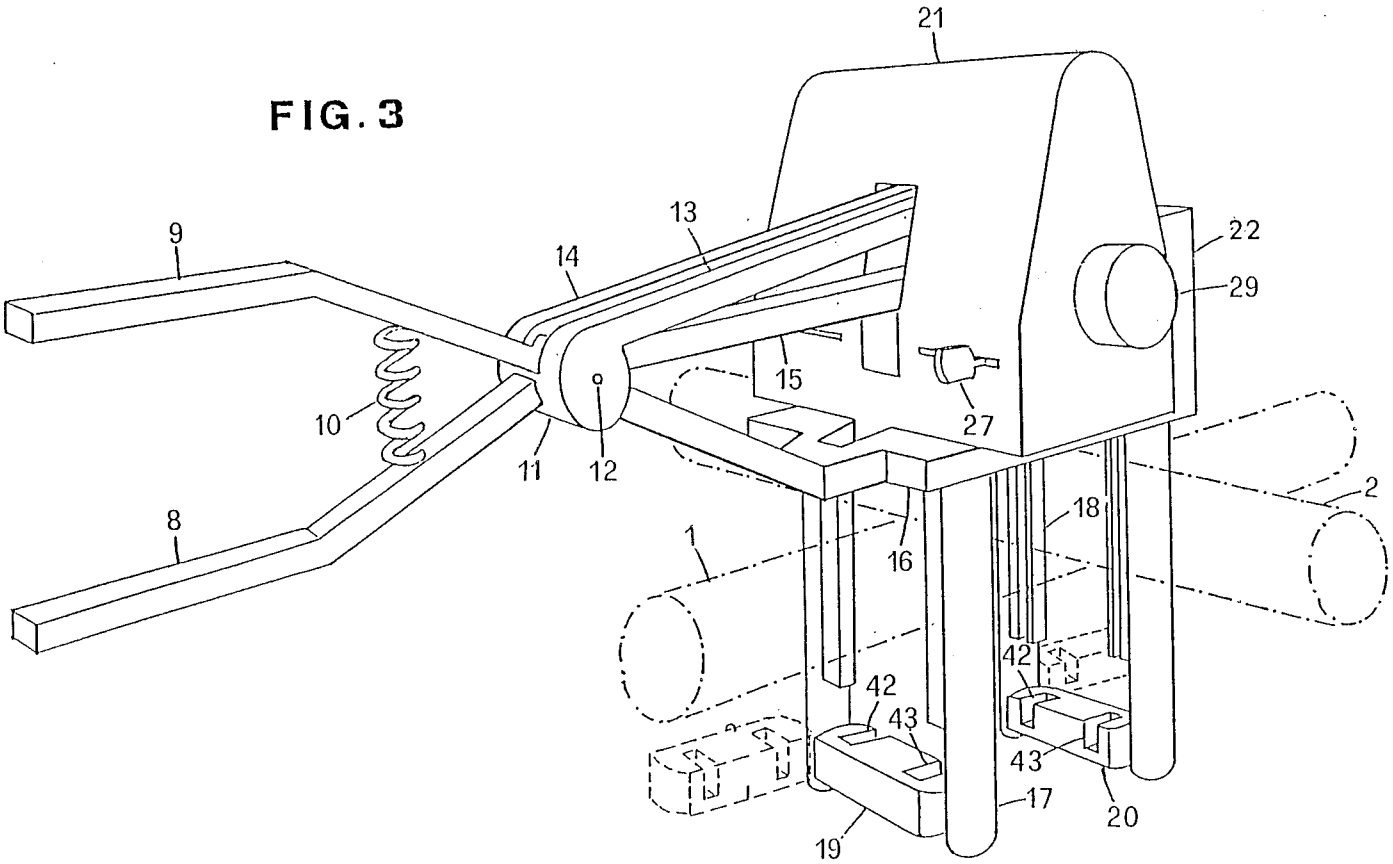
FIG. 3 is a perspective view of the first embodiment of the apparatus in question.
Figure 7:
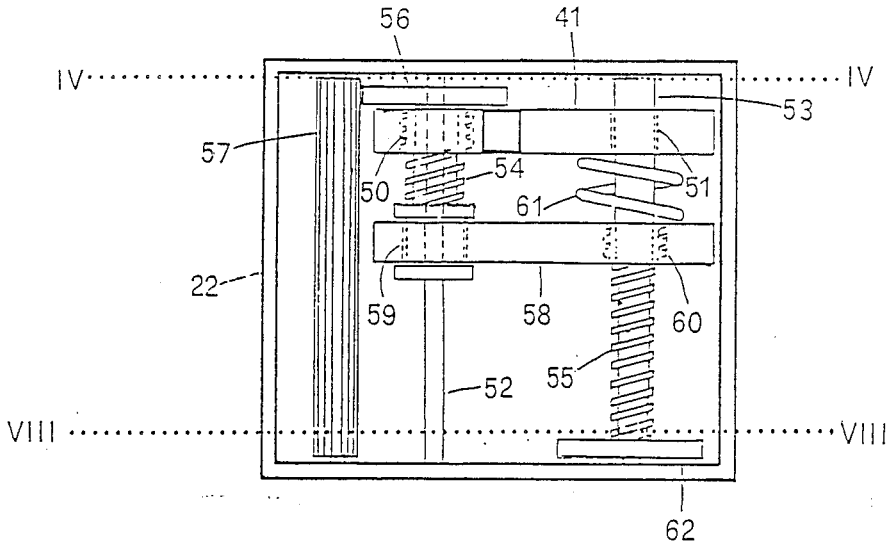
FIG. 7 is a sectional view taken along lines VII—VII of FIG. 4 and of FIG. 8.

In FIG. 7 is shown the mechanism provided to force drums 19 and 20 to carry out a first rotation through 90° to bring them from the disengaged position to the operative position, respectively shown with dotted lines and solid lines in FIG. 3, and a second rotation on their own axis to perform the appropriate twisting of the ends of the respective forks, as shown in FIG. 2.

In the figure in question the first movable plate 41 may be noted, mentioned with reference to FIGS. 4 and 5, which is mounted by means of a threaded hole 50 and a through hole 51 on respective rotatable shafts 54 and 53 of which the first, constituted by the tubular member, has an external thread corresponding to that of said hole 50 and is mounted coaxially on a fixed shaft 52, while the second has a smooth upper portion and a thread 55 in the lower part. On the top end of the shaft 54 a toothed wheel 56 is keyed meshing with a pinion 57. The lower end of the shaft 54 is integral with a stub coaxial with the fixed shaft 52 with which, by means of a through hole 59, a second movable plate 58 is engaged, which is also provided with a threaded hole 60 in engagement with the thread 55. Between the plates 41 and 58 a helical spring 61 is interposed on the shaft 53 on the lower end of which a toothed wheel 62 is keyed.

Figure 8:
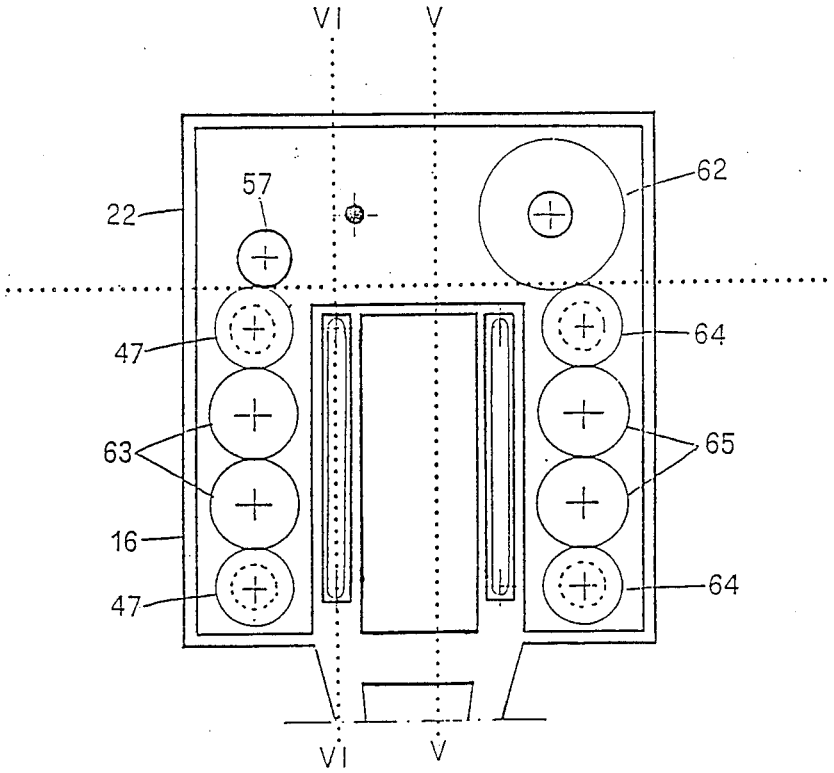
FIG. 8 is a partial sectional view taken along lines VIII—VIII of FIG. 5, FIG. 6 and FIG. 7.

In FIG. 8 is shown the transmission system (contained in the base 16) of the movements of the mechanism, described with reference to FIG. 7, to the drums 19, 20 for the performance of the first and second of said rotations.

In particular the pinion 57 is keyed with the top end, correspondingly splined, of the shaft 47, to which it transmits the movement, rotatably contained in the left forward leg 17, as is seen in FIG. 3, which through the pair of intermediate toothed wheels 63 transmits in its turn the movement to shaft 47 rotatably contained in the left rear leg 17, as is seen in FIG. 3, causing the supports 44 (see FIG. 6) of the drums 19, 20 to rotate in this way through 90°, in one sense or the other according to the sense of rotation of the pinion 57, to bring the latter from said disengagement position to said operative position and the converse.

The toothed wheel 62, in its turn, meshes with the top end, suitably splined, of the shaft 64, to which it transmits movement, rotatably contained within the right forward leg 17, as is seen in FIG. 3, which through the pair of intermediate toothed wheels 65 transmits the rotation to the shaft 64 rotatably contained in the right rear leg 17, as is seen in FIG. 3, in such a manner as to rotate the drums 19 and 20, which are in said operative position, on their own axes, as will be described hereinafter in greater detail.

Figure 9:
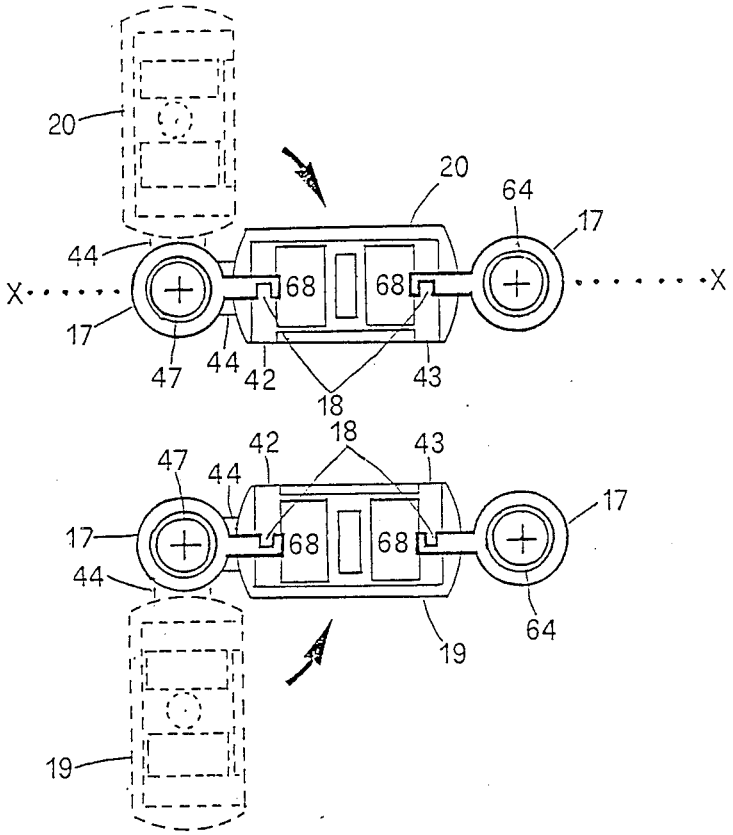
FIG. 9 is a sectional view taken along line IX—IX of FIG. 6.
Figure 10:
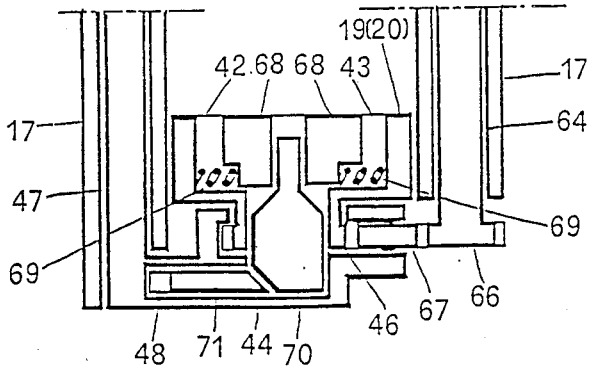
FIG. 10 is a sectional view taken along line X—X of FIG. 9.
Figure 11:
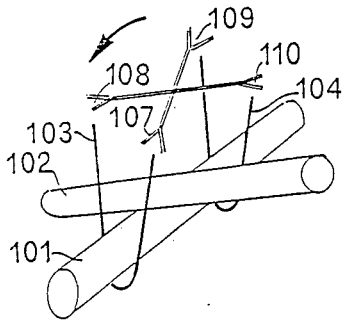
FIGS. 11 and 12 are perspective views which show schematically the operating principle of a second embodiment of the apparatus in the case of superposed bodies in an axially angulated relationship and in an axially parallel relationship.
Figure 12:
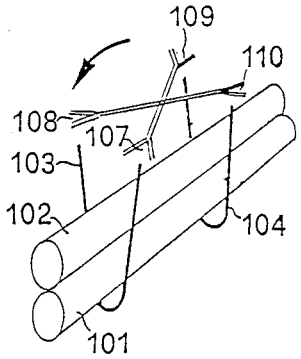

In FIG. 9 is shown in greater detail, with respect to FIG. 3, the rotation through 90° made in the sense of the arrows by the drums 19 and 20 through the related underlying supports 44 to bring them from the disengagement position, shown with dotted lines, to the operative position, shown with solid lines, capable of engaging the respective ends of two forks 25 (not shown), extending beyond the lower ends of the channel shaped guides 18 (see also FIG. 6), in the respective recesses 42 and 43, in which they will be locked by means of the clamps 68, the operation of which will be explained with reference to the following FIG. 10, for the subsequent twisting in order to complete the strapping in question.

With reference to FIG. 10, all the schematically shown components of the apparatus in question may be noted more clearly, which operate directly on each of the drums 19, 20 (and the pertaining supports 44) for the accomplishment of the preliminary rotation through 90° and the subsequent rotation around their own axis, referred to several times during the present disclosure, as well as the structure and the operation of the abovementioned clamps 68 for the locking of the ends of the forks 25 (not shown) introduced in the recesses 42 and 43 fo the respective drums 19 and 20.

At the left and right side of the figure in question may be noted the left forward or rear leg 17 and respectively the right forward or rear leg 17, as seen in FIG. 3, shaft 47 being rotatably contained in the first and shaft 64 being rotatably contained in the second. The lower end of shaft 47 is connected to the support 44 of drum 19 (20) which has already performed the preliminary rotation through 90° from the disengagement position to the operative position. In this latter position, the toothed wheel 66, provided on the lower end of the shaft 64, meshes with an intermediate toothed wheel 67 which in its turn meshes with the toothed wheel 46 keyed on the pin 45 for the rotation of the drum 19 (20).

With the above described arrangement, the rotation movement of the shaft 64 is transmitted to the drum 19 (20) which rotating around its own axis will be able to effect the twisting of the ends of the forks 25 (not shown) engaged in the recesses 42 and 43 in which they are locked by the clamps 68.

As may be remarked from FIG. 10, each of the clamps 68 comprises a movable block arranged for displacement, against the action of a respective helical spring 69, in the direction of the narowing of corresponding recess 42, 43 until locking the ends of the forks 25 (not shown) therein received. For the abovesaid displacement of the blocks 68 a separator-retractor member 70 is provided which has a top parallelepipedal extension as a stop for the blocks 68 in the open position against the bias of the respective springs 69, joined underneath to two inclined plane shoulders arranged for the reciprocal spreading apart of the blocks 68, with a consequent narrowing of the recesses 42, 43 for the abovementioned purpose, when the member 70 is lifted against the push of a tapered end of a rod 71 which operates on a camming surface created on the corresponding edge at the base of the member 70 itself, the rod 71 being displaced towards the member 70 following the introduction of the tooth 49, on the legs 17 mentioned with reference to FIG. 6, within hole 48 in the support 44 of the respective drum 19, 20, owing to the fact that the face of the rod 71 opposed to the one in contact with the member 70 is shaped as an inclined plane in a direction perpendicular to the plane of FIG. 10.

In the operation of the present example of embodiment of the apparatus of the invention as it has been disclosed previously in detail, premitting that the directions of movement of the movable parts will be indicated as seen in the drawings, the handles 8 and 9 are gripped with one hand and the legs 17 are placed straddling the reinforcing rods 1 and 2 in the point of superposition (see FIG. 3). By squeezing the grasped handles 8 and 9, the first one will rotate towards the second around the pin 12 with a consequent downward rotation of the levers 13 and 14 which through the coupling of the gear sectors 35 on the second internal ends with the respective gear sectors 34 of the flat rods 33 will cause the latter to rotate downwards, which in their turn entrain in the same direction pins 31, slidable in the respective slots 32, (see FIG. 5) and consequently the sliders 30 integral with them. The lowering of the sliders 30 brings the respective forks 25, one from each container 23, 24, into the position for the performance of the strapping, indicated in dotted lines in FIG. 6, with the ends protruding beyond the free ends of the channel shaped guides 18 associated to respective pairs of legs 17 up to the level of the recesses 42, 43 in the drums 19, 20 in which they will be inserted following the rotation through 90° of the drums 19, 20 from the disengagement position, shown in dotted lines in FIGS. 3 and 9 and in solid lines in FIG. 6, to the operative position, shown in solid lines in FIGS. 3 and 9, and in which they will be locked by means of the blocks (see FIG. 10) of the clamps 68 displaced in the locking position against the action of the springs 69, by means of the inclined plane shoulders of the separator-retractor member 70 when this is lifted by the displacement of the respective rods 71 which operate on the camming surfaces of the former when, as already said, each of the teeth 49 is inserted into the corresponding hole 48 (see FIG. 6). At this moment the manner in which the abovesaid rotation through 90° of the drums 19, 20 occurs should be detailed, as well as the subsequent rotation of the same around their own axis for the completion of the strapping operation of the reinforcing rods 1 and 2 under consideration.

As stated above, lever 15 is interposed between the levers 13 and 14 and consequently the downward rotation of the latter will cause the rotation in the same sense of the former around the pin 12 by means of the bar 36, with pin 40 which slides within the slot 39 (see FIG. 5). On the other hand, as will be remembered, the internal end of the lever 15 is fastened to the first movable plate 41 and consequently the latter will be pulled downwards firstly along the threading on shaft 54, with which its threaded hole 50 is engaged, and along the smooth upper part of shaft 53, with which its through hole 51 is engaged, with a consequent compression of the helical spring 61, and then pulling with it in said movement the second movable plate 58 along the threading 55 on the shaft 53, with which its threaded hole 60 is engaged, and along the shaft 52 with which its through hole 69 and the related support sleeve are engaged. The movement of the first plate 41 along the threading on shaft 54 will cause the rotation of the latter with the consequent rotation of the toothed wheel 56 and of the pinion 57 which will rotate through 90° the shaft 47 contained in the interior of the forward left leg 17, as seen in FIG. 3, which in turn, by means of the idling wheels 63 (see FIG. 8), transmits a similar rotation to shaft 47 contained in the interior of the rear left leg 17, as seen in FIG. 3, so that the drums 19 and 20, by means of the respective supports 44 connected to the lower ends of said shafts 47, will go from said position of disengagement to said operative position. With the drums 19 and 20 in the operative position, the toothed wheel 46 keyed on the rotation pin 45 of each of them (see FIG. 6) will engage, by means of the idling toothed wheel 67 (see FIG. 10), the toothed wheel 66 on the lower end of the shaft 64 contained in the respective one between right legs 17, as seen in FIG. 3. With the abovementioned arrangement the rotation of the toothed wheel 62, determined by the downward pull of the second movable plate 58 along the threading 55 on the shaft 53, (see FIG. 7), will rotate the shafts 64 through the engagement of one of them (see FIG. 8) and the transmission of the movement to the other one through the idling toothed wheels 65, obtaining in this way the rotation of the respective toothed wheels 66 and consequently of the drums 19, 20 around their own axes as a consequence of the above describe coupling. As a consequance of the above, the ends of the forks 25 engaged and locked in the recesses 42, 43 of the respective drums 19 and 20 are twisted, as schematically shown in FIG. 2, obtaining the desired strapping.

In the reversed phase of disengagement of the apparatus in question from the strapped reinforced rods 1 and 2, the movable plate 41 will be firstly displaced upwards, under the bias of the spring 61, previously compressed, rotating the toothed wheel 56 the pinion 57 and the shafts 47 in a contrary sense, the latter performing a rotation through 90° will return the drums 19 and 20 to the starting position after the unlocking of the clamps 68 performed as a consequence of the exit of the teeth 49 from holes 48 which will allow the displacement downwards of the separator-retractor member 70 under the action of the springs 69 on the respective blocks 68. The upwards movement of the second movable plate 58 will then follow, with an idle rotation of the shafts 64. When the return stroke of the plates 41 and 58 is completed, sliders 30 will also resume their starting positions following the reverse movement of levers 13 and 14 as a consequence of the restoring spring 10 between handles 8 and 9, which pushes apart the second one from the first one as a consequence of the release of the initial squeeze, while in the meantime the push plates 26 in the loaders 23 and 24 will have brought another pair of forks 25 into the position of engagement with the sliders 30. When the forks 25 are finished, the push plates 26 will be displaced to the initial end of stroke, i.e. the one shown in FIG. 4, by means of the respective knobs 27 and the loaders 23 and 24 will be filled again With reference to FIGS. 11 to 14 the principle of operation of a second example of embodiment of the apparatus of the present invention for strapping together two reinforcing rods 101 and 102 placed in a superposed relationship either crossed or parallel is schematically shown, entailing the operations of: predisposing two strapping elements, under the form of forks 103 and 104 made of relatively rigid and flexible material, straddling under the lower reinforcing rod 101 on opposed ends of the upper reinforcing rod 102; to engage the ends of the forks 103 and 104 in respective clamps 107, 108, 109 and 110 of a rotatable device; to rotate said device in the sense indicated by the arrow in order to twist all the ends of the forks 103 and 104 together, as is shown in FIGS. 13 and 14, constituting in this way the desired strapping.

Figure 15:
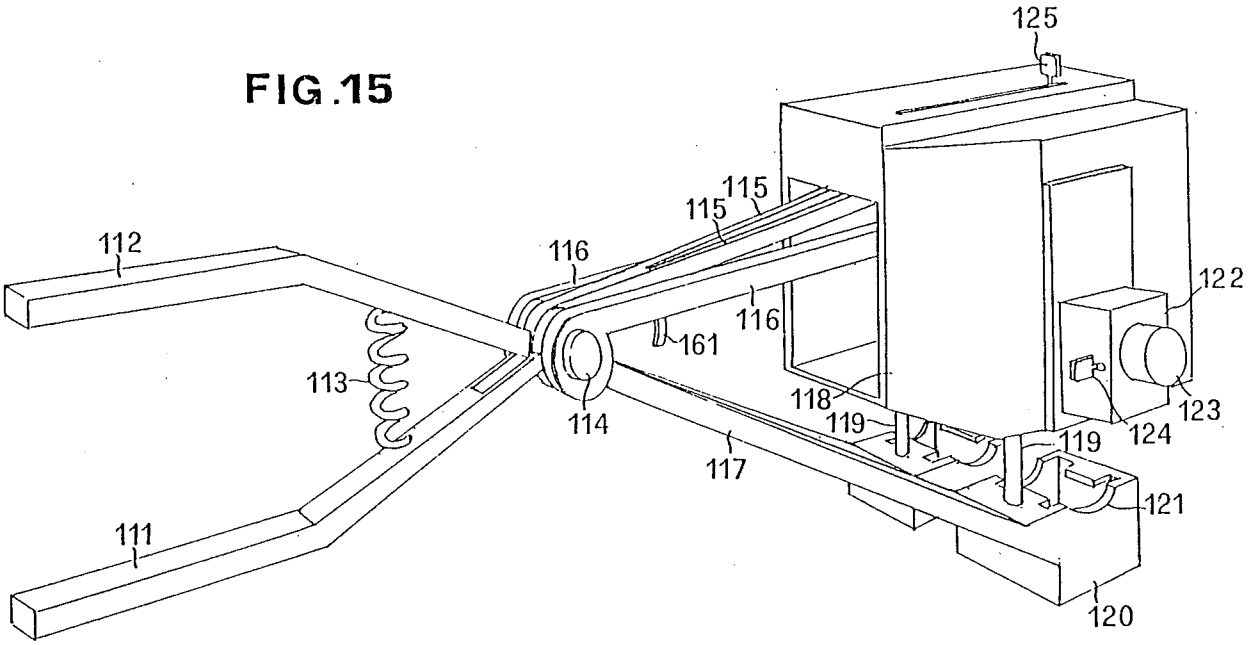
FIG. 15 is a perspective view of the second embodiment of the apparatus in question.

Passing now to consider FIG. 15 wherein an overall view of a second example of embodiment of the apparatus is shown, and premitting that the components illustrated therein will be referred to without too many details deferring to the prosecution of the present discussion the description of the details relating the members arranged for the operation of the apparatus itself as specifically shown in the following figures, a movable handle is indicated by 111 and a fixed handle by 112, between which a helical return spring 113 is interposed. The movable handle 111 is rotatable around a pin 114 and is integral with a pair of levers 115, which actuate with their ends a mechanism which will be disclosed in the following, contained in a carter 118, which is displaced vertically by said pair of levers 15. The fixed handle 112 is integral with the pin 114 and with a pair of extensions 117 extending beyond the pin 114 and integral with two box-like bodies 120, from the upper face of which two pins 119, one for each box-like body, extend perpendicularly, which operate as a guide to the carter 118 in its vertical movements. A further pair of levers 116 is hinged on the pin 114, around which they can rotate freely, the opposed ends of said two levers 116 converging, in the interior of the carter 118, into a small plate 126 (represented in FIGS. 16, 17 and 19), which is held raised by a helical spring 127. At the sides of the carter, are applied, one for each side, two containers 122, which will be disclosed in greater detail below.

Passing now to consider in detail the constructional details for the operation of the apparatus of the present example of embodiment, reference is made first of all to FIG. 17 and to FIG. 18, wherein two containers are indicated by 122, arranged to house a plurality of strapping elements previously proportioned and shaped, as better seen in FIG. 19, and indicated by 128, placed side by side, and identified in the following as forks.

As they are utilized, the forks 128 within each container 122 are advanced by means of respective push plates 129, each one provided with external knobs 124 for the manual displacement to the start position (see also FIG. 15) under the constant bias of helical springs 130 contained in hollow cylindrical housings 123, until bringing the innermost fork of each container 122 under a respective slider 131 (see also FIG. 19) activated, by engagement with a slot, by a pin 132 integral with one of the two levers 116. Said pair of levers 116 is lowered by exerting manual pressure on the small plate 126 which compresses the spring 127, which returns the small plate 126 to the starting position when the manual pressure ceases.

Figure 16:
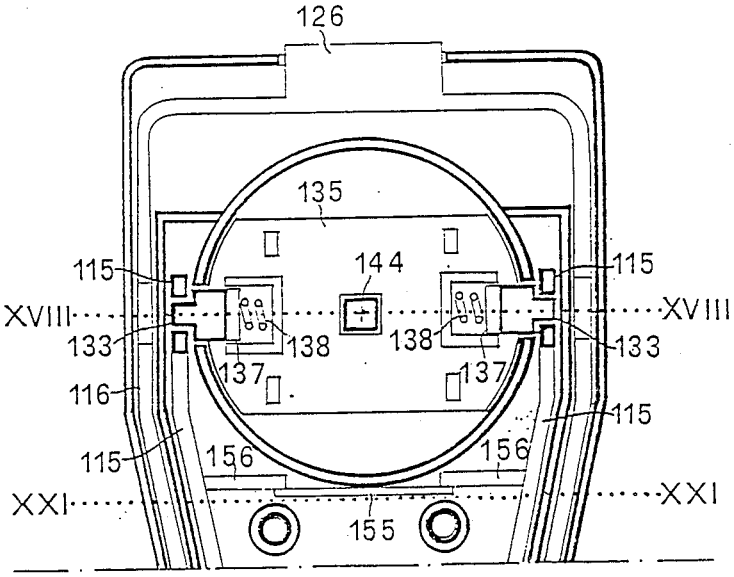
FIG. 16 is a partial sectional view taken along lines XVI—XVI of FIG. 18 and FIG. 19.
Figure 18:
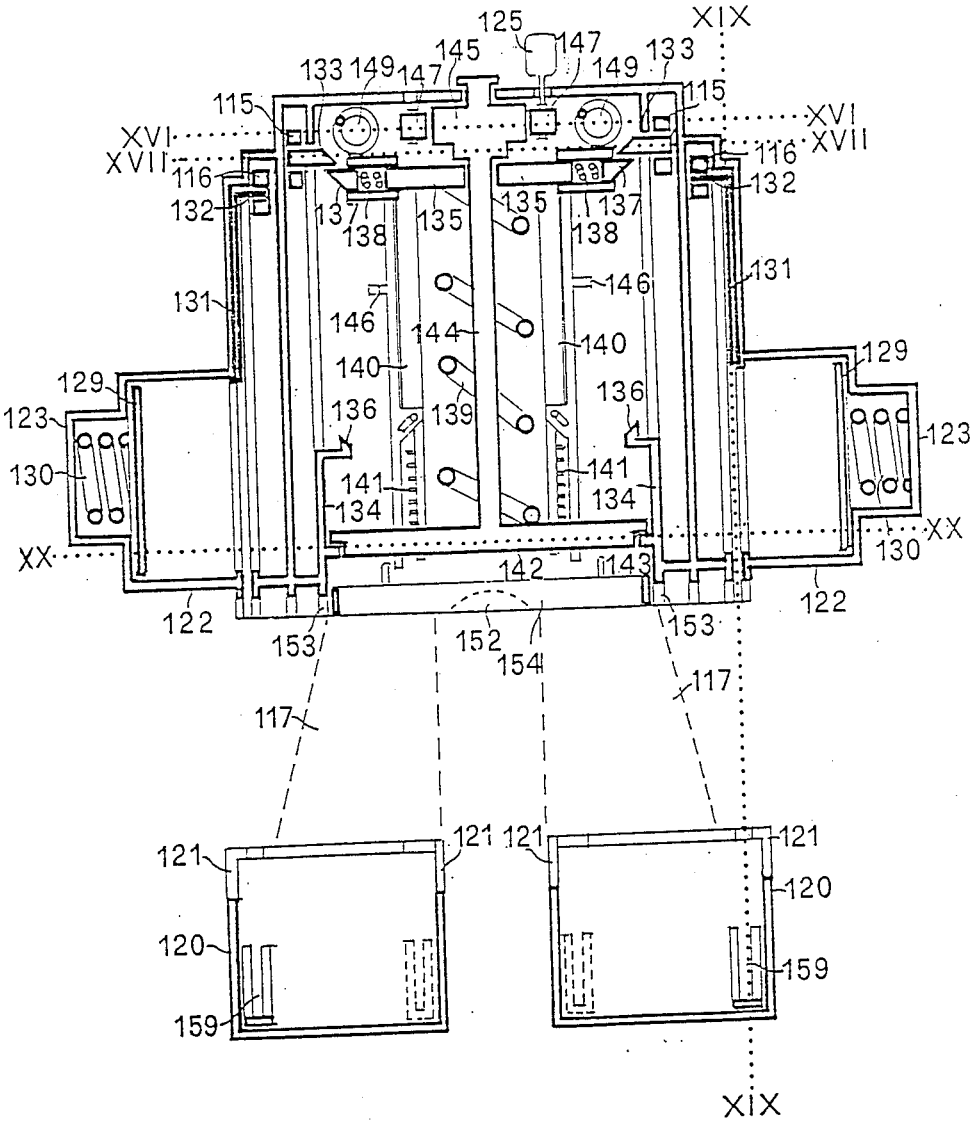
FIG. 18 is a partial sectional view taken along lines XVIII—XVIII of FIG. 16, FIG. 17, FIG. 19, and FIG. 21.

It may be appreciated from FIG. 16 and from FIG. 18 that the ends of the pair of levers 115 integral with the movable handle 111 are engaged with two pawls 133 which, under the push of the pair of levers 115, slide vertically each within a groove machined in a cylinder 134 up to an abutment 136 represented in FIG. 18; in their displacement in a vertical sense said pawls 133 push a plate 135 downwards until said abutments 136 have displaced the sliding blocks 137 (see FIGS. 16 and 18) compressing the springs 138. As a consequence of the displacement of said sliding blocks 137, said plate 135 is disengaged from said pawls 133 and, under the bias of the helical spring 139 (see FIG. 18), it returns to the starting position. Four vertical segments 140 are integral at their upper end with the plate 135, and each of them is provided with a clamp 141 at its lower end, and they pass through a circular drum 142, supported by a ridge 143 in said cylinder 134 and capable of rotating under the action of a square-section shaft 144 which passes throuh said plate 135 and is integral at its upper end with a toothed wheel 145. In its rotation the drum 142 forces into rotational movement the four vertical segments 140 provided with clamps 141 as well as said plate 135. Immediately before plate 135 disengages itself from the pawls 133 the protruding dogs 146, with which the sements 140 are provided, strike against the upper plane of the drum 142, thus causing the locking of the clamps 141.

Figure 20:
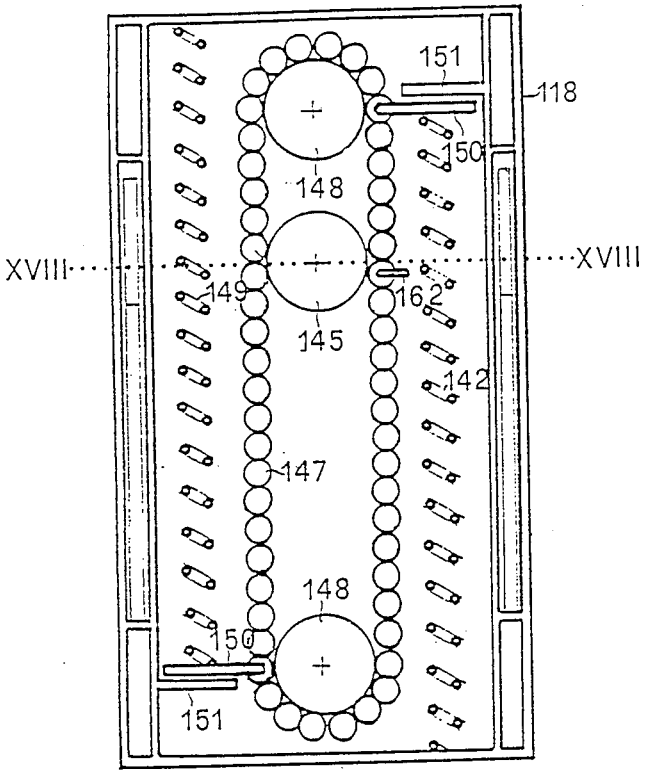
FIG. 20 is a partial sectional view taken along line XX—XX of FIG. 18 and FIG. 19.

The toothed wheel 145 engages with a chain transmission 147 (see also FIG. 20) which is supported by two independent toothed wheels 148. Two helical springs 149 compress two ridges 150 of the chain 147 against a corresponding number of ridges 151 fastened to the carter 118. By means of a manual displacement of knob 125 integral with one of the ridges 150 of the chain 147, the ridge 150 is brought to lock itself to a blocking device, not shown; located in the position of maximum compression of the helical springs 149; the unlocking of the ridge 150 is controlled by plate 135, which operates on said blocking device when the spring 139 brings back said plate to the starting position at maximum height after the abutments 136 have disengaged it from the pawls 133.

Figure 21:
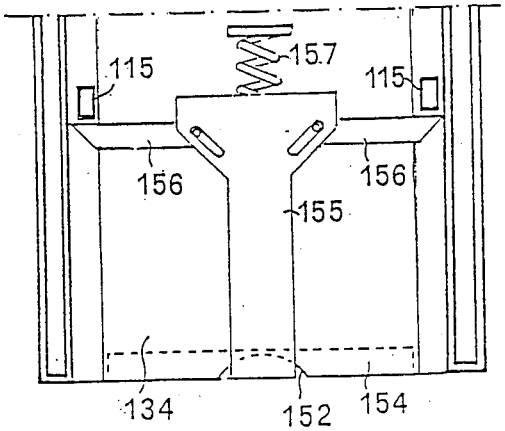
FIG. 21 is a partial sectional view taken along line XXI—XXI of FIG. 16 and FIG. 17.

On the lower edge of the cylinder 134, in the direction of the longitudinal axis of the apparatus, two rests 152 are cut, one of which is shown in dotted lines in FIG. 18 and, in the direction of the transversal axis, two similar rests 153 are cut, which in the same FIG. 18 are seen in sectional view; a circular strap 154 adherent to the internal surface of the cylinder 134 and which can be slid upwards is connected to a small vetical plate 155 (see FIGS. 16, 17 and 21) which controls the horizontal translation of two tie-rods 156, which are kept separated in the rest position by the pressure of the helical spring 157, preventing the downward displacement of the two levers 115.

Figure 19:
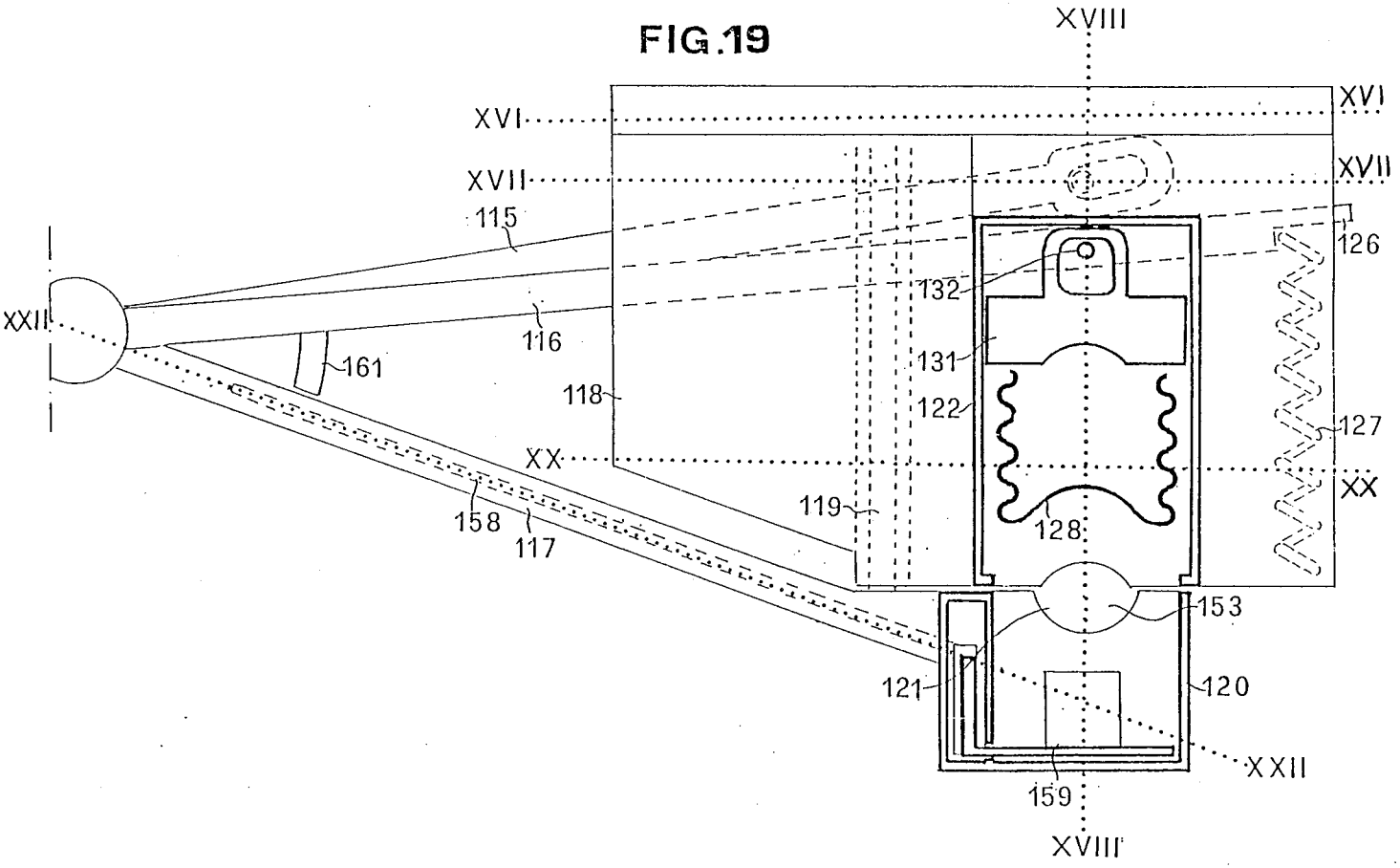
FIG. 19 is a partial sectional view taken along lines XIX—XIX of FIG. 17 and FIG. 18.
Figure 22:
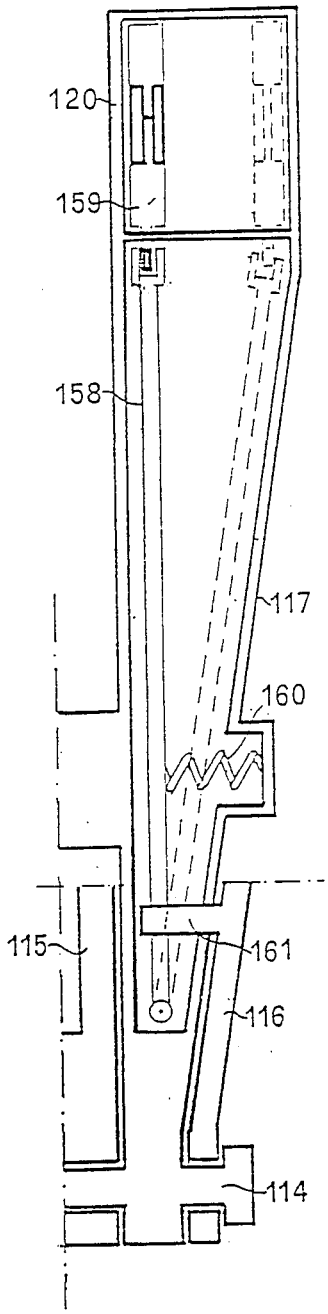
FIG. 22 is a partial sectional view taken along line XXII—XXII of FIG. 19.

FIG. 22, which is a partial sectional view taken along the line XXII—XXII of FIG. 19, shows a lever 158 which, in the interior of each of the two extensions 117, displaces a support 159 contained in each of the two box-shaped bodies 120 in the direction transversal to the apparatus 1; the lever 158, which in the rest position is kept compressed against the internal wall of the extension 117 by the action of a helical spring 160, may be displaced towards the exterior by a hook 161 applied to the lever 116.

For the operation of the present example of embodiment of the apparatus of the invention as disclosed previously in detail, the operations are performed in two steps, which may be respectively defined: loading phase and working phase.

In the first phase, the loading one, the handles 111 and 112 are grasped with one hand and, squeezing them, the pair of levers 115, prevented from lowering with respect to the cylinder 134 by the pair of tierods 156, compels the whole carter 118, integral with the cylinder 134, to approach the box-like bodies 120 in a direction perpendicular to the upper face of said box-like bodies 120 because they are guided by the pins 119. When the approach has been completed, and consequently in the position represented in FIG. 19, with a finger of the other hand pressure is exerted on the small plate 126 with a consequent lowering of the pair of levers 116; in the first portion of said lowering, while the pin 132 of each of the two levers 116 runs from top to bottom of the slot in the respective slider 131, the corresponding hook 161 integral with the lever 116 displaces towards the exterior the lever 158 contained in the respective extension 117, and the lever 158 in its turn displaces towards the exterior the support 159; consequently in the second portion of said lowering of each of the levers 116 the pin 132 displaces the slider 131 downwards, which in its turn pushes downwards the first of the forks 128 contained in the container 122, until bringing it to the support 159 which in the meantime will be located in the box-like body 120 in the position represented by the dotted lines in FIG. 18, and which corresponds to the vertical with respect to the slider 131. On ceasing to exert pressure on the small plate 126, the helical spring 127 returns to the starting position, and consequently each one of the two pins 132 brings back upwards each of the two sliders 131, and each of the two levers 158, disengaged from the respective hook 161 brings the respective support 159 back to the interior in the rest position, which is located on the vertical of a pair of the four segments 140 provided with the clamps 141. The return of the sliders 131 to their rest position upwards allows each of the helical springs 130 to push another fork contained in each of the two containers 122 under the slider 131. Having stopped the pressure on the small plate 126 with a finger of the hand which does not keep handles 111 and 112 closed, with said hand the knob 125 connected to the chain 147 is pulled from the rest position up to the locking position with the blocking device, in this way putting the two helical springs 149 under the maximum compression.

At this moment, by releasing the force on the two handles 111 and 112, the helical spring 113 separates the pair of levers 115 and also the extensions 117, with a consequent moving away of the carter 118 from the pair of box-like bodies 120 up to the initial rest position. At this moment the first phase, identified as the loading phase, in concluded.

The second phase of the operation, the so-called working phase, begins placing the two box-like bodies 120 under the lower elongated element which is located in a transversal direction to the apparatus, taking care that each of the two box-like bodies 120 is placed respectively on one side and the other of the upper elongated memeber, if said two elongated bodies which are to be strapped together are superposed in an axially angulated relationship. Then with one hand the knobs 111 and 112 are squeezed, so that the pair of levers 115, prevented by the pair of tie-rods 156 from lowering with respect to the cylinder 134, compels the whole carter 118 to approach the pair of box-like bodies 120, until said upper elongated body contacts the lower edge of the circular strap 154 in correspondence with the pair of rests 152 if the upper elongated body is in an axially angulated relationship with respect to the lower elongated body, or in correspondence with the pair o rests 153 if the upper elongated body is axially parallel to the lower elongated body; in both cases the pressure which the upper elongated body exerts on the lower edge of the circular strap 59 displaces the small vertical plates 55 upwards, which in its turn causes the horizontal translation of the two tie-rods 156, with a consequent unlocking of the pair of levers 115. By continuing to squeeze the handles 111 and 112 the pair of levers 115, free to move with respect to the cylinder 134 which has stopped approaching, together with the carter 118 with which it is integral, the pair of box-like bodies 20 because it is prevented from so doing by said elongated members interposed to be strapped together, pushes the pair of pawls 133 downwards, which in their turn push downwards the plate 135 and with this latter the four vertical segments 140 each provided with a clamp 141 at its lower end. The four vertical segments 140, passing through the circular drum 142, introduce the clamps 141 into the underlying box-like bodies 120, in pairs in correspondence with the ends of said pair of supports 159, each of which is loaded with a fork 128 placed there in the previous loading phase. When the dogs 146 protruding from the vertical segments 140 strike against the upper face of the circular drum 142, said clamps 141 close grasping and locking the two pairs of legs of the two forks 128, at a greater or lesser distance from the ends according to whether said clamps 141 are more or less introduced within the box-like bodies 120, and the greater or lesser introduction of the clamps 141 into said box-like bodies 120 depends upon the sum of the thicknesses of said two elongated bodies to be strapped, said sum of thicknesses maintaining more or less separated from each other the carter 118 and the box-like bodies 120.

Almost at the same time as the locking of the clamps 141, the pawls 133 reach the abutments 136, which cause, with the displacement of the sliding blocks 137, the disengagement of the plate 135, which under the action of the helical spring 139 is pushed upwards along with the vertical segments 140 with the pertaining clamps 141 with which they are provided. The legs of the two forks 128, clamped in the clamps 141, are drawn as a consequence of the upwards translation of their ends, which are brought up to within the circular drum 142, while the transversal portions of the forks 128 are held under said lower elongated member to be strapped.

Figure 13:
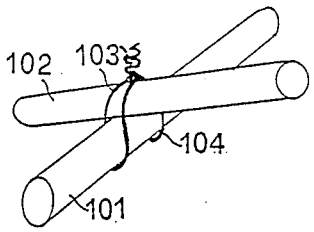
FIGS. 13 and 14 are perspective views which show schematically the result of the strapping operation performed according to the operating principle shown in FIG. 1 and in FIG. 2, wherein the rotatable system of four clamp elements is schematized.
Figure 14:
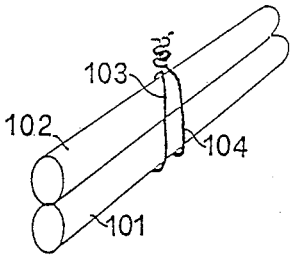

At the end of its upwards stroke, the plate 133 operates on the blocking device, not shown, of the ridge 150 fastened to the transmission chain 147, causing it to unlock and allowing the two helical springs 149 to exert their pressure on the ridges 150, which cause the chain 147 to run around the independent toothed wheels 148. By running, the transmission chain 147 causes the rotatin of the toothed wheel 145 which, by means of the shaft 144, transmits its rotational motion to the circular drum 142, and also to the group of four clamps 141 which clamp the ends of said pair of forks 128. As a consequence of the above, the ends of the two forks 128, engaged and locked by said clamps 141 in rotational motion, are all twisted together, as is schematically shown in FIGS. 13 and 14, obtaining thus the desired strapping.

Regarding what has been said before with reference to the distance from the ends of the forks 128 on which the clamps 141 are clamped, it should be noted that said distance may vary as a function of the sum of the thicknesses of the elongated bodies to be strapped and it results therefrom that the length of the portion of fork available to perform the desired strapping is automatically determined by said sum of thicknesses and consequently the number of turns necessary to perform the desired twisting of the ends is constant and independent from the thickness of the members to be strapped. Said number of turns is impressed on the toothed wheel 145 by a complete stroke of the transmission chain 147 from the position of maximum compression of the helical springs 149 up to the impact of the ridges 150 with the ridges 151 fastened to the carter 118. At the end of said stroke, a pawl 162 (see FIG. 20), with which the transmission chain 147 is provided, compresses a small lever, not shown, on the upper face of the plate 135, and said small lever actuates the opening of the clamps 141, freeing the twisted ends of the forks.

By releasing the grasp of the hand that kept closed the handles 111 and 112, the helical spring 113 brings the pair of levers 115 to the starting position and consequently moves the carter 118 away from the pair of box-like bodies 120.

In this way the second phase of the operation, defined working phase, is also concluded.

Figure 17:
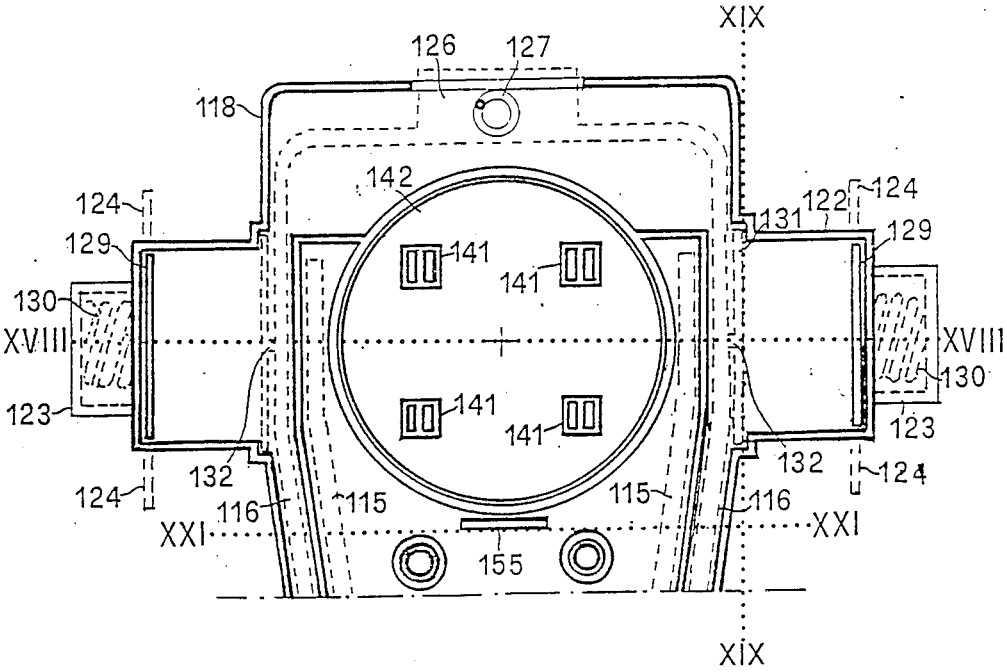
FIG. 17 is a partial sectional view taken along lines XVII—XVII of FIG. 19.

When the forks 128 contained in the containers 122 are exausted, the push plates 129 are displaced to the end of the initial stroke, i.e. in the position shown in FIG. 17, by means of the knobs 124 and the containers 122 are filled again.

It should be remarked that the experts in the field may make numerous modifications to the examples of embodiments of the present invention, as above disclosed in detail, and said modifications and variations may regard the shape, arrangement, and means of actuation of the various components, all these falling within the spirit and scope of the invention itself.

Consequently the present invention is not limited to the disclosed examples of embodiments, but encompasses any changes and/or modifications of the same.

I claim:

1. An automatic apparatus for the strapping of elongated superposed bodies, comprising: at least one container wherein several, relatively rigid and previously proportioned and shaped strapping wire-like elements are placed side by side; pushing means in said at least one container, capable of bringing each of said wire-like elements in succession at respective entrainment means, capable of carrying in a guided way, at each stroke, two of said wire-like elements in a straddling position on the upper of said superposed elongated bodies, each along opposite sides of the lower one; two drums associated to first and second means which impart to each of them respectively a first rotation from a disengaged position to an operating position and a second rotation around their axis when they are in said operating position, each of said drums being provided with two housings in which, following the execution of said first rotation, the respective ends of said two wire-like elements in said straddling position on said superposed elongated bodies to be strapped are received and locked, by means of clamp means, in such manner that the subsequent execution of said second rotation of said drums provides the twisting in pairs of said ends of said wire-like elements performing the desired strapping; means to bring back to their respective starting positions movable components consisting of said pushing means, said entrainment means, said drums and said clamp means.

2. An apparatus according to claim 1, wherein said wire-like strapping elements are fork shaped.

3. An apparatus according to claim 1, wherein said pushing means is, in respect of said at least one container, a plate slidable under the action of at least one spring capable of making said wire-like strapping elements placed side by saide advance until bringing each of them in succession under said entrainment means as they are used for the execution of strappings, said plate being provided with grasping knobs to bring it to the start position in order to allow the refilling of said at least one container following the utilization of all said wire-like elements located therein.

4. An apparatus according to claim 1, wherein said entrainment means comprise a slider for said at least one container associated to lever systems connected to manual or motor actuating means capable of displacing it in a direction such as to bring, by pushing upon them, respective wire-like strapping elements in said straddling position on said superposed elongated bodies to be strapped.

5. An apparatus according to claim 4, wherein said drums are rotatably mounted by means of rotation pins on respective supports fastened to the lower end of a first and a second shaft, respectively, rotatably contained at the interior of a first and a second tubular leg extending perpendicularly from the base of said apparatus.

6. An apparatus according to claim 5, wherein said first means for imparting to said drums said first rotation comprise first gears connected to manual or motor actuating means capable of rotating said first and second shafts fastened to the supports of respective drums through an angle such as to bring these latter from a disengaged position to an operative position.

7. An apparatus according to claim 6, wherein said second means for imparting to said drums said second rotation comprise second gears connected to manual or motor actuating means capable of rotating a third and fourth shaft rotatably contained in a third and fourth tubular leg extending perpendicularly from the base of said apparatus, the lower ends of said third and fourth shaft being connected by means of gears to said rotation pins of respective drums in said operating position.

8. An apparatus according to claim 7, wherein said means for bringing back said movable components to their respective starting positions comprise springs previously compressed during the active phase of said apparatus, the release of which, at the end of the strapping operation, causes the movement in a contrary sense of said system of levers and of said first and second gears.

9. An apparatus according to claim 1, wherein said clamp means for locking respective ends of said wire-like strapping elements within housings in said drums comprise blocks movable by means of cam devices in the narrowing direction of the respective ones among said housings against the bias of spring devices, said cam devices being actuated following the actuation of said first rotation of said drums.

10. An automatic apparatus for the strapping of superposed elongated bodies, comprising: at least one container wherein several wire-like strapping elements are placed, which are relatively rigid and previously proportioned and shaped; pushing means in said at least one container capable of bringing in succession each of said wire-like elements at respective entrainment means arranged to carry in a guided way at each stroke two of said wirelike elements in a straddling position under the lower of said superposed elongated bodies, flanking along opposed edges the upper one of said superposed elongated bodies; four locking devices, suitable for grasping and locking the two ends of each of said two wire-like elements; means coupled to said locking devices to impose a suitable number of rotations on them in order to twist said ends of said wire-like elements together, thus performing the desired strapping; means to bring back to the respective starting positions movable components consisting of said pushing means, said entrainment means, said locking devices and said means coupled to the locking devices.

11. An apparatus according to claim 10, wherein said strapping wire-like elements are fork shaped and are specifically shaped to be locked at a variable distance from the end of their ends.

12. An apparatus according to claim 10, wherein said pushing means comprise for said at least one container a plate slidable under the bias of at least one spring capable of advancing said side by side wire-like strapping elements until bringing each of them in succession under said entrainment means as they are gradually utilized to perform strappings, said plate being provided with a strapping knob for bringing it back into the starting position in order to allow the re-loading of said at least one container following the utilization of all said wire-like elements contained therein.

13. An apparatus according to claim 10, wherein said entrainment means comprise a slider for said at least one container associated to lever systems connected to manual or motor actuation means capable of displacing it in a direction, pushing on it, such as to bring respective wire-like strapping elements into said position to straddle said superposed elongated bodies to be strapped.

14. Apparatus according to claim 13, wherein said means for bringing back said movable components comprise springs previously compressed during the active phase of said apparatus, the release of which, at the end of the strapping operation, causes the movement in a contrary sense of said system of levers and of said locking devices.

15. An apparatus according to claim 10, wherein said locking devices are capable of locking the ends of said wire-like elements at a distance variable from their ends.

16. An apparatus according to claim 10, wherein said locking devices consist of clamps.

17. Apparatus according to claim 10, wherein said means coupled to said locking devices comprise a supporting frame rotatable around its axis capable of rotating under the bias of spring devices.

* * * * *